US006095360A

United States Patent [19]

Shmagin et al.

[11] Patent Number: 6,095,360

[45] Date of Patent: Aug. 1, 2000

[54] VERTICAL-RIB REINFORCED BOTTLE

[75] Inventors: Dmitriy Shmagin, Streamwood; Sherry Yuan, Oak Lawn; Jizu John Cheng, Burr Ridge, all of Ill.

[73] Assignee: Crown Cork & Seal Technologies Corporation, Alsip, Ill.

[21] Appl. No.: 09/176,606

[22] Filed: Oct. 21, 1998

[51] Int. Cl.[7] ..... B65D 90/02

[52] U.S. Cl. ..... 215/382; 220/673

[58] Field of Search ..... 215/370, 378, 215/379, 384, 382; 220/669, 670, 671, 672, 673, 675; D9/530, 536, 537, 538, 539, 541, 552, 557, 556, 565, 569

[56] References Cited

U.S. PATENT DOCUMENTS

| | | | |
|---|---|---|---|
| D. 22,058 | 12/1892 | Rockwood | D9/545 |
| D. 62,785 | 7/1923 | Marble | 215/556 |
| D. 193,637 | 9/1962 | Ferraro | 215/382 X |
| D. 272,321 | 1/1984 | Kretz | D9/542 |
| D. 365,757 | 1/1996 | Stenger | D9/502 |
| 4,749,092 | 6/1988 | Sugiura et al. | 215/381 |
| 5,261,542 | 11/1993 | Ugarelli | 215/375 |

*Primary Examiner*—Stephen P. Garbe
*Assistant Examiner*—Tri M. Mai
*Attorney, Agent, or Firm*—Woodcock Washburn Kurtz Mackiewicz & Norris LLP

[57] ABSTRACT

A bottle for storing and dispensing fluid comprises a side and at least one vertical rib section situated on the side for improving the bottle's vertical strength. Each vertical rib section comprises a plurality of vertical ribs being vertically and radially-outward extending projections, and panels that separate the vertical ribs. Preferably, the bottle further comprises at least two shoulders on the side, each shoulder being a radially-outward extending projection on the side and being centered at a height along the side of the bottle, wherein each shoulder and each rib section completely surround the side of the bottle such that the plurality of ribs are evenly spaced around the circumference of the bottle.

10 Claims, 5 Drawing Sheets

VERTICAL-RIB REINFORCED BOTTLE

FIELD OF THE INVENTION

The present invention relates to bottles for storing and dispensing fluid.

BACKGROUND OF THE INVENTION

Bottles for storing and dispensing fluid are well known. Most commonly, such bottles are blow-molded plastic containers. Such bottles are often used to contain fluids such as beverages. One of these bottles is used repeatedly before its contents are consumed and is often re-used. The bottles, therefore, have to be strong enough to withstand repeated use as well as manufacturing and handling prior to consumption.

A top perspective view of a typical prior art bottle for storing and dispensing beverages such as drinking water is shown in FIG. 1. To provide the required strength, a prior art bottle is typically equipped with horizontal ribs 10. Generally, these horizontal ribs 10 are projections 12 on the side of the bottle defined by recessions 8 from the side of the bottle. Such prior art horizontal ribs 10 generally surround the entire circumference of the bottle.

One drawback of prior art bottles having horizontal ribs 10 as shown in FIG. 1 is that while the ribs 10 provide strength in the radial direction, the horizontal ribs 10 do not provide strength for the bottle in the vertical direction. Strength is needed in the vertical direction so that bottles can be stacked on top of each other such as during transport, storage or display. In addition, strength is needed in the vertical direction to withstand the vertical forces applied to the bottle during the capping process. It is, therefore, desirable to provide a plastic blow-molded bottle that has improved vertical strength over prior art bottles.

It is particularly desirable to provide a plastic blow-molded bottle that has improved vertical strength for the same amount of material used in prior art bottles. Because of the impact on manufacturing costs, there is a constant need to reduce the amount material necessary to achieve a structurally sound bottle. It is, therefore, desirable to provide a plastic blow-molded bottle that has a greater vertical strength-to-weight ratio than prior art bottles.

SUMMARY OF THE INVENTION

A bottle for storing and dispensing fluid is provided. The bottle comprises a side and at least one vertical rib section situated on the side for improving the bottle's vertical strength. Each vertical rib section comprises a plurality of vertical ribs being vertically and radially-outward extending projections, and panels that separate the vertical ribs.

In a preferred embodiment, the bottle further comprises at least two shoulders on the side, each shoulder being a radially-outward extending projection on the side and being centered at a height along the side of the bottle, wherein each shoulder and each rib section completely surround the side of the bottle such that the plurality of ribs encompass the side of the bottle.

Preferably, the plurality of ribs are evenly spaced around the bottle and each of the plurality of ribs on each rib section are approximately the same size. In addition, each vertical rib preferably has a substantially partially-cylindrical shape and each vertical rib has a radius of curvature between approximately 3 mm. and approximately 9 mm.

In alternate embodiments, there are two vertical rib sections axially-spaced apart. The number of vertical ribs also varies between 6 to 14 vertical ribs around the circumference of the bottle.

BRIEF DESCRIPTION OF THE DRAWINGS

FIG. 3A-1 is an enlarged view of section 1 of the cross section of FIG. 3A.

DETAILED DESCRIPTION OF THE PREFERRED EMBODIMENTS

Figure 2:
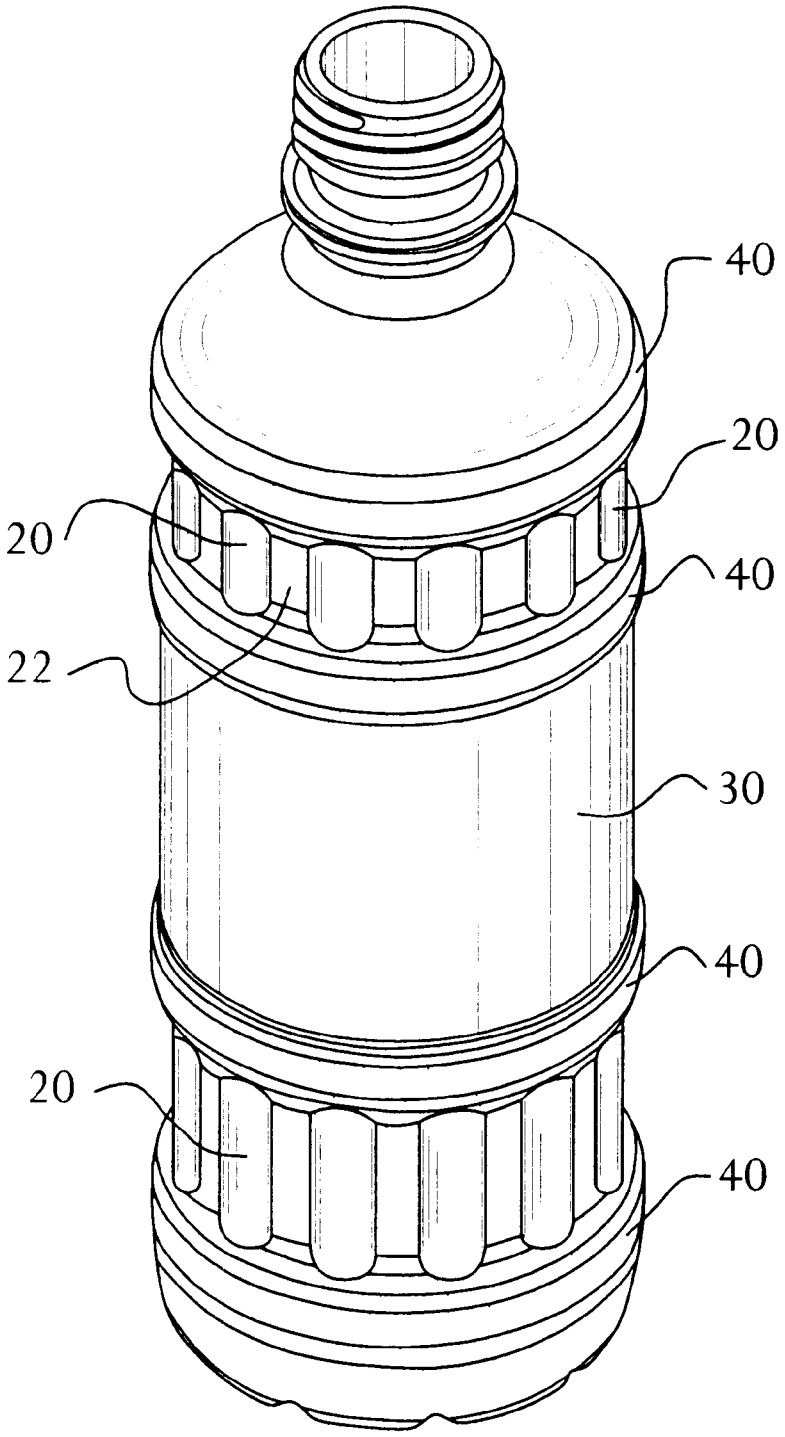
FIG. 2 a top perspective view of a bottle of the present invention.
Figure 3:
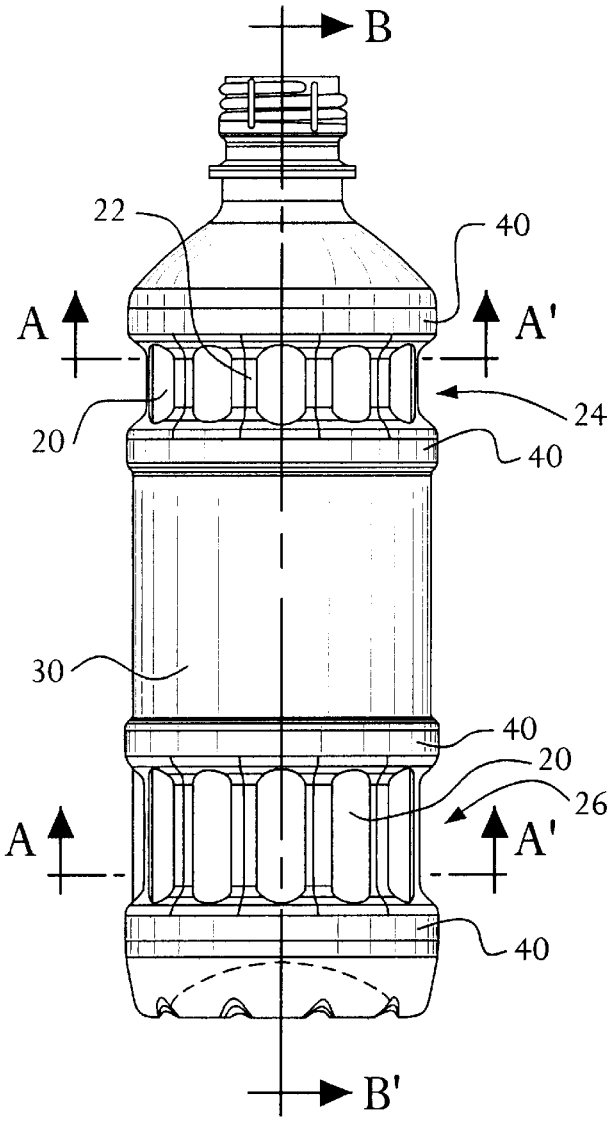
FIG. 3 is a side view of the bottle of FIG. 2.
Figure 4:
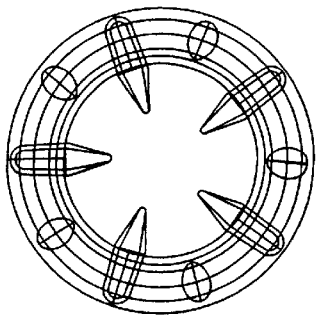
FIG. 4 is a bottom view of the bottle of FIG. 2.

The purpose of the present invention is to provide a bottle that has greater vertical strength than prior art rib portions. FIG. 2 shows a top perspective view of a preferred bottle of the present invention, FIG. 3 shows a side view of the bottle of FIG. 2, and FIG. 4 shows a bottom view of the bottle of FIG. 2. The bottle of the present invention provides the much-needed vertical strength by providing vertical ribs 20.

Preferably, the bottle of FIG. 2 has two sections 24 and 26 of vertical ribs 20, although the number of vertical rib sections may be varied. This preferred bottle which contains approximately 0.5 liter, has ten vertical ribs 20 around the circumference of each vertical rib section 24 and 26. The vertical ribs 20 are projections separated by panels 22 that are substantially smooth. Preferably, a bottle of this size has 6 to 14 vertical ribs 20 around the circumference, more preferably 8 to 12 vertical ribs 20, and most preferably ten vertical ribs 20.

Figure 1:
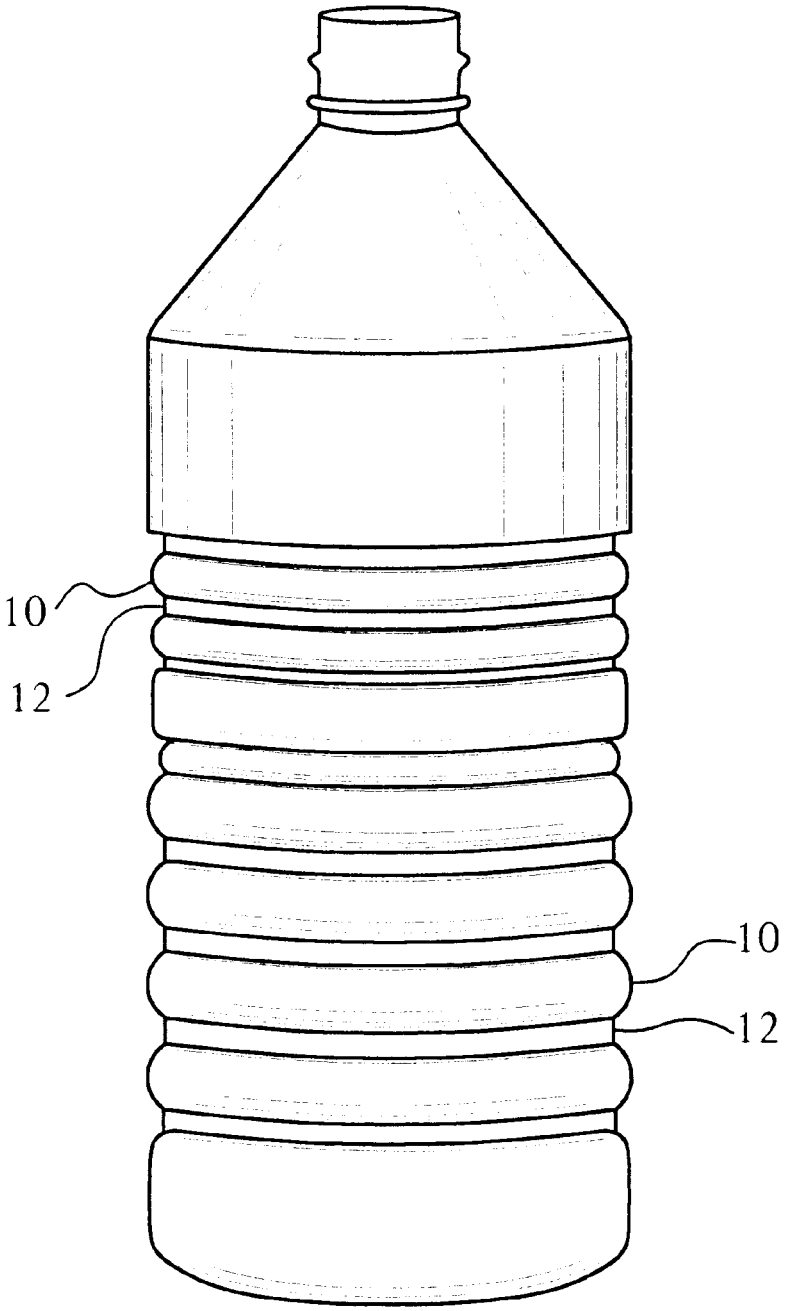
FIG. 1 PRIOR ART
FIG. 1 is a top perspective view of a prior art bottle.
Figure 3A:
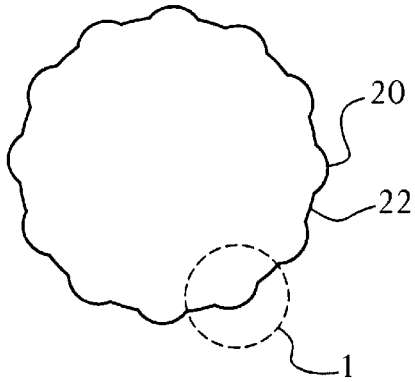
FIG. 3A is a cross-sectional view of the bottle of FIG. 3 along each of the two lines A–A'.

FIG. 3A shows the cross-sectional view of the bottle of FIG. 3 along each of the two lines A–A', depicting the cross sections of the vertical rib sections 24 and 26. Each vertical rib 20 has a partially-cylindrical shape, i.e., is generally a cut-away section of a cylinder and therefore, has a radius of curvature $R_2$ (FIG. 3A-1). In this preferred embodiment, the panels 22 are substantially rectangular in shape. Preferably, for a 0.5 liter bottle, the radius of curvature $R_2$ of a vertical rib 20 is between approximately 3 mm. and approximately 9 mm., more preferably between approximately 4 mm. and approximately 8 mm., even more preferably between approximately 5 mm. and approximately 7 mm., and most preferably approximately 6 mm. Although it is preferable for each vertical rib 20 to have the same radius of curvature $R_2$, the size of the ribs 20 on a bottle may be varied to obtain results of improved strength in accordance with the principles of the invention.

Figure 3B:
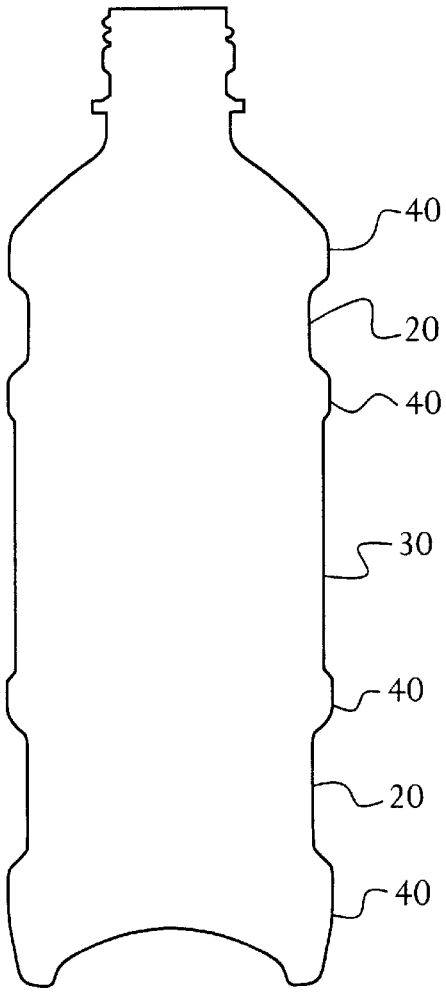
FIG. 3B is a longitudinal cross-sectional view of the bottle of FIG. 3 along line B–B'.
Figures 1, 3A:
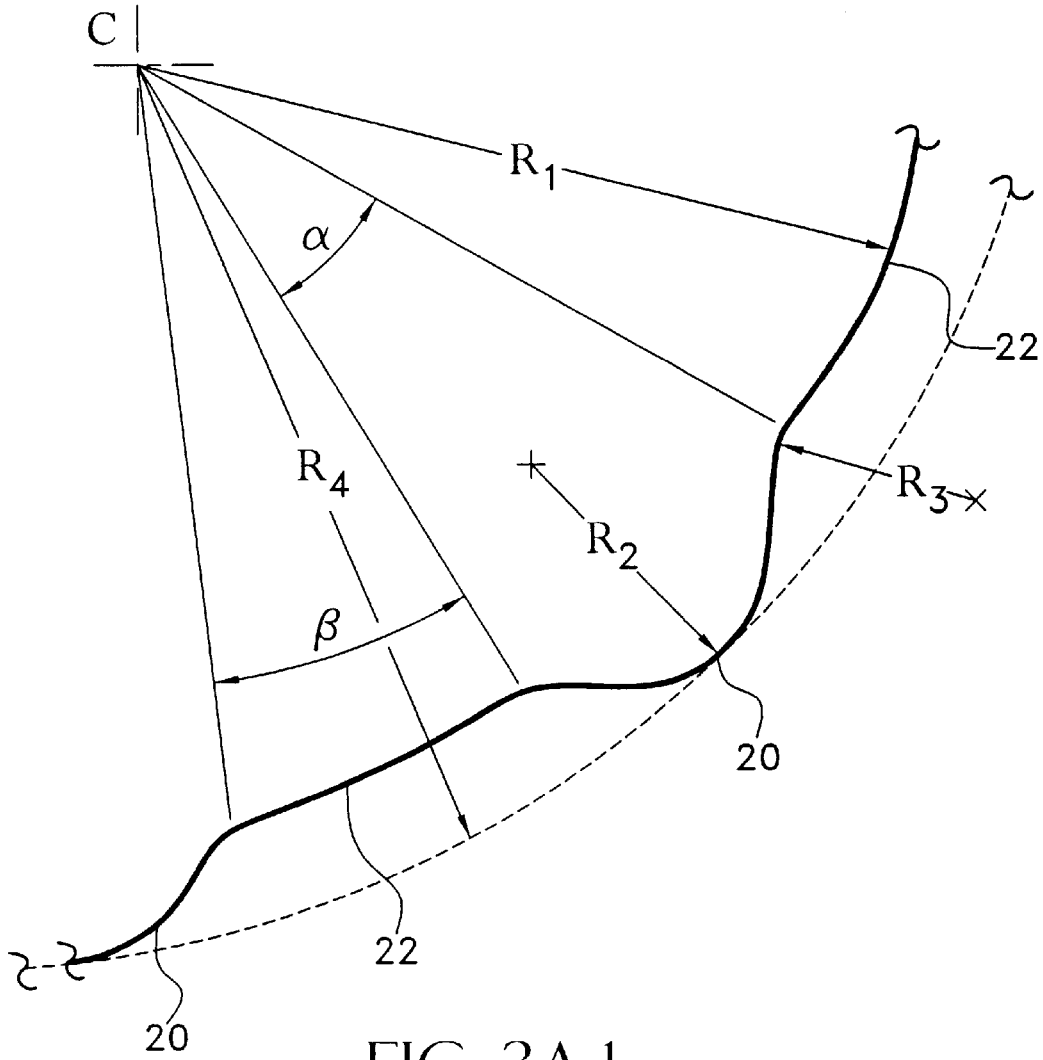

FIG. 3B shows a longitudinal cross-sectional view of the bottle of FIG. 3 along line B—B'. The vertical ribs 20 extend longitudinally between shoulders 40 that have a larger diameter than vertical rib sections 24 and 26. As shown in the Figures, a generally smooth middle section 30 of the bottle is situated between the two vertical rib sections 24 and 26 and defined by the two middle shoulders 40. A product label may be placed on the middle section 30 of the bottle.

FIG. 3A-1 shows an enlarged view of section 1 of the cross section of FIG. 3A. Preferably, for a 0.5 liter bottle, the radius $R_1$ of each vertical rib section 24 and 26 at the panel 22 (from the center C of the bottle to the panel 22) is approximately 29.5 mm., the radius $R_4$ of each vertical rib section 24 and 26 at the panel 20 is approximately 31.5 mm., the radius of curvature $R_3$ at the juncture of each vertical rib 20 and panel 22 is approximately 0.05 mm., the sector angle $\alpha$ which each vertical rib 20 encompasses is approximately 15 degrees and the diameter of each shoulder 40 is approximately 67 mm.

Preferably, the sector angle $\alpha$ which each vertical rib 20 encompasses is between approximately 5 degrees and approximately 25 degrees, more preferably between approximately 10 degrees and approximately 20 degrees, and most preferably approximately 15 degrees. In addition, the sector angle $\beta$ which each panel 22 encompasses is preferably less than the sector angle $\alpha$ which each vertical rib 20 encompasses, but more than approximately one degree. Furthermore, as the invention is incorporated on a larger bottle, it is preferred that either the number of vertical ribs 20 on a given rib section increases or the radius of curvature $R_2$ increases on a given number of ribs 20.

The vertical rib sections 24 or 26 of the present invention provide improved vertical strength over prior art bottle designs. Each vertical rib 20 acts as a support column for maintaining the vertical and overall structural integrity of the bottle. Each shoulder 40 serves as a platform to yield a plurality of shorter support columns (or ribs 20) as opposed to long individual columns that are structurally weaker. The shoulders 40, acting as horizontal ribs, also add to the radial strength of the bottle.

Using vertical ribs 20 in place of numerous horizontal ribs 10, the bottle of the present invention can achieve greater vertical strength for the same amount of material used in prior art bottles. If the greater strength is not necessary in certain applications, this increased vertical strength-to-weight ratio results in lower manufacturing costs.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. A bottle for storing and dispensing fluid, the bottle having a generally cylindrical shape, comprising:

a side having a generally smooth central label area having a first diameter;

at least one vertical rib section situated on said side for improving the bottle's vertical strength, each vertical rib section comprising:

a plurality of vertical ribs being vertically and radially-outward extending projections; and discrete panels that separate the vertical ribs;

at least two shoulders on said side, each shoulder being a radially-outward extending projection on said side and being situated at a certain height along said side of the bottle, wherein each shoulder and each rib section completely surround said side of the bottle such that said plurality of ribs encompass said side of the bottle, each shoulder having a second diameter larger than the first diameter of the central label area, wherein each rib section is situated between and bounded by two shoulders, thereby defining the length of each rib by contact.

2. The bottle of claim 1, wherein there are two vertical rib sections axially-spaced apart.

3. The bottle of claim 1, wherein said plurality of ribs are evenly spaced around the bottle.

4. The bottle of claim 1, wherein each of said plurality of ribs on each rib section are approximately the same size.

5. The bottle of claim 1, wherein each vertical rib has a substantially partially-cylindrical shape.

6. The bottle of claim 5, wherein each vertical rib has a radius of curvature between approximately 3 mm. and approximately 9 mm.

7. The bottle of claim 5, wherein each vertical rib has a radius of curvature between approximately 4 mm. and approximately 8 mm.

8. The bottle of claim 5, wherein each vertical rib has a radius of curvature between approximately 5 mm. and approximately 7 mm.

9. The bottle of claim 5, wherein each vertical rib has a radius of curvature of approximately 6 mm.

10. A bottle for storing and dispensing fluid, the bottle having a substantially cylindrical shapes, comprising:

a side having a generally smooth central label area having a first diameter;

four shoulders on said side, each shoulder being a radially-outward extending projection on said side and being situated at a certain height along said side of the bottle, wherein each shoulder and each rib section completely surround said side of the bottle such that said plurality of ribs encompass said side of the bottle, each shoulder having a second diameter larger than the first diameter of the central label area, and two vertical rib sections situated on said side for improving the bottle's vertical strength, each section situated between and bounded by two shoulders, each vertical rib section comprising:

ten vertical ribs being vertically and radially-outward extending that are evenly spaced around the circumference of the bottle, each rib having a substantially partially-cylindrical shape having a radius of curvature of approximately 6 mm.; and panels separating the ribs, each vertical rib and panel extending between the two shoulders defining said vertical rib section.

* * * * *

UNITED STATES PATENT AND TRADEMARK OFFICE

CERTIFICATE OF CORRECTION

PATENT NO. : 6,095,360

DATED : August 1, 2000

INVENTOR(S) : Shmagin et al.

It is certified that error appears in the above-indentified patent and that said Letters Patent is hereby corrected as shown below:

Cover Page, Column 2, Line 4 of "U.S. PATENT DOCUMENTS", delete "5,261,542" and insert --5,261,543-- therefor.
Cover page, column 2, beneath "U.S. PATENT DOCUMENTS" insert: --OTHER PUBLICATIONS
Sanpellegrino B.B. Too beverage container (1.5 liters)
té alla pesca BELTÈ (in acqua minerale VERA) beverage container (1.5 liters)-- therefor.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*